United States Patent [19]

Sigmon

[11] 4,024,012

[45] May 17, 1977

[54] METHOD AND APPARATUS FOR MAKING A HOLLOW FILTER AND A FILTER ROD

[75] Inventor: Ned A. Sigmon, Durham, N.C.

[73] Assignee: Liggett & Myers Incorporated, Durham, N.C.

[22] Filed: July 16, 1975

[21] Appl. No.: 596,471

Related U.S. Application Data

[63] Continuation of Ser. No. 391,581, Aug. 27, 1973, abandoned.

[52] U.S. Cl. ..... 156/441; 93/77 FT; 156/201; 156/461; 264/174

[51] Int. Cl.[2] ..... B29H 9/00

[58] Field of Search ..... 156/201, 461, 441, 204; 93/1 C, 77 FT; 264/174; 131/10 R, 10 A, 10.7, 10.9, 261 R, 261 A

[56] References Cited

UNITED STATES PATENTS

| | | | |
|---|---|---|---|
| 2,666,947 | 1/1954 | Shaw | 264/174 X |
| 3,016,945 | 1/1962 | Wexler | 156/441 X |
| 3,323,961 | 6/1967 | Gallagher | 156/441 X |
| 3,546,325 | 12/1970 | Muller | 156/441 X |
| 3,637,447 | 1/1972 | Berger et al. | 156/441 X |
| 3,668,045 | 6/1972 | Molins | 156/441 |

*Primary Examiner*—David A. Simmons
*Attorney, Agent, or Firm*—Michael L. Hendershot; J. Bowen Ross, Jr.

[57] ABSTRACT

The apparatus is constructed to produce a hollow filter rod. The apparatus includes a mandrel through which a supplied length of tubing is passed, a nozzle surrounding the mandrel for shaping a stream of fibrous filter material about the mandrel and a forming means for enveloping a web of paper about the fibrous filter material and the tubing to produce the filter rod. The mandrel can be adjusted relative to the forming means to ensure an accurate centering of the tubing within the filter rod.

The hollow filter includes a rigid non-deformable tube defining a smoke passage having a draw resistance to control the amount of unfiltered smoke, a concentric layer of filter material and a perforated outer wrap for passage of air into the layer of filter material.

10 Claims, 5 Drawing Figures

METHOD AND APPARATUS FOR MAKING A HOLLOW FILTER AND A FILTER ROD

This is a continuation of application Ser. No. 391,581, filed Aug. 27, 1973 now abandoned.

This invention relates to a method and apparatus for forming a filter rod. More particularly, this invention relates to a method and apparatus for forming a hollow filter rod for use in making filters for cigarettes.

Heretofore, various types of filters have been devised for use in cigarettes in order to screen out various filterable materials in the smoke generated during smoking. For example, filters made up of fibrous materials, such as a cellulose acetate, have been known for filtering out particulate matter from the smoke generated during smoking. However, such a filtering medium between a smoker's mouth and the tobacco column of the cigarette generally requires additional drawing or inhaling forces on the part of the smoker in order to draw the smoke through the filtering material. As a result, a practical limit has been imposed on the amount of particulate matter that can be filtered out by a particular filtering material due to the need to have a pressure drop across a filter that can be tolerated by a smoker without discomfort.

In more recent times, attempts have been made to dilute the smoke stream from a cigarette with ventilating air to reduce the quantity of particulate matter drawn into a smoker's mouth for each puff while allowing the taste to pass through. Some of these attempts have used bypass arrangements by which a greater or lesser proportion of the cigarette smoke can be bypassed around a filter medium and drawn into a smoker'mouth. In some cases, the filters have been provided with passageways through which a portion of unfiltered smoke can be passed directly to the smoker's mouth. Such passageways have usually been provided directly in the filter material and the filter material has been constructed so as to be collapsed manually about the passageway to constrict the size of the passageway and, thus, reduce the proportion of unfiltered smoke passing through to a smoker, for example as described in U.S. Pat. Nos. 3,242,925 and 3,270,750.

One of the reasons for utilizing filters with bypass passages is that the flow of unfiltered smoke can be drawn through the filter at a greater speed than the filtered flow which passes through the filtered material so that the faster flow can impinge upon the tongue and taste buds of the smoker at a greater impact speed than the normal. This is believed to impart a greater taste to the smoke. At the same time, since only a smaller proportion of the smoke is directed into the smoker's mouth, a smaller proportion of particulate matter is drawn into the smoker's mouth.

However, the relationship of the bypass passage to the air flow paths have not been accurately determined or maintained. Further, the techniques for making filters with bypass passageways as described above have been relatively cumbersome. Also, the various techniques have not consistently achieved a centering of the passageways to produce a filter which is not only pleasing in appearance but also efficient in operation.

Accordingly, it is an object of the invention to provide a means of centering a smoke bypass passage within a filter media of a filter to accurately direct a high velocity stream of smoke into a smoker's mouth.

It is another object of the invention to provide a means of producing hollow filters for cigarettes on a continuous in-line basis.

It is another object of the invention to provide an apparatus which can be utilized on existing machinery for producing hollow filter rods.

It is another object of the invention to provide an apparatus of relatively few parts for producing hollow filter rods for cigarettes.

Briefly, the invention provides a method and apparatus for making a continuous filter rod for making hollow cigarette filters in which the filter allows a portion of unfiltered smoke to enter a smoker's mouth at high velocity while diluting the smoke with drawn-in air in the mouth.

The filter is used in combination with a cigarette tobacco section and is joined to the tobacco section by a cylinder or outer wrap of tipping paper. The filter is constructed of a rigid non-deformable tube, a layer of compacted filter material and a cylinder of perforated or inherently porous plug wrap paper. The tube defines a smoke passage of constant cross-sectional area throughout having a draw resistance for controlling the amount of unfiltered smoke entering a smoker's mouth for a given draw. The layer of filter material surrounds the tube and is formed e.g. of cellulose acetate. The plugwrap paper is porous, e.g. the paper is either inherently highly porous or has numerous perforations some of which are aligned with perforations in the tipping paper. In either case, the number and size of the perforations in the tipping paper define the air flow path through the tipping paper and the layer of filter material to a smoker's mouth. The flow path is of a draw resistance to complement the draw resistance of the smoke passage whereby for a given draw a desired amount of unfiltered smoke and ventilation air are drawn into the smoker's mouth.

The method of the invention includes the steps of generating a first stream of hollow tubing and a second stream of fibrous filter material, of placing these streams in juxtaposition during travel at a first station while simultaneously enveloping the fibrous filter material circumferentially about the tubing, and of circumferentially enveloping a stream of paper about the juxtaposed streams of tubing and fibrous filter material during continued travel to form a filter rod. During movement of the various continuous streams of materials, the fibrous material is constricted about the tubing to frictionally engage the tubing so that the tubing is positively gripped for continued travel with the fibrous material. The movement of the filter rod is carried out in any conventional fashion such as by the use of a conveyor belt. The movement of the rod, in turn, allows continued movement of the fibrous material and therefore the tubing.

The fibrous material which is used to make up the filter rod can be of any suitable material such as a cellulose acetate tow. The tubing is made of a self-supporting structure and is of a material, such as a plastic tube, of small diameter.

The apparatus of the invention includes a mandrel having a passageway for passage of a supplied stream of tubing, a means which circumferentially envelopes the mandrel to direct a supply stream of fibrous filter material circumferentially about the mandrel and a forming means for receiving the supplied streams of tubing and filter material along with a stream of paper and for circumferentially enveloping the paper about the filter material and tubing to form a filter rod.

The means for enveloping the fibrous material about the mandrel and the forming means can be of known construction, as is conventionally used in forming filter rods of fibrous filter material of solid construction. For example, this means can be in the form of a nozzle having a Venturi-opening and an air supply as described in British Pat. No. 933,827.

The mandrel cooperates with a means for supplying a stream of tubing and is adjustable relative to the forming means to accurately position the tubing at the center of the produced filter rod.

The means for supplying the tubing includes a supply reel, a means for driving the reel such that the tubing is fed from the reel at a relatively constant rate compatible with the rate of consumption, a take-up roll to accommodate variations between feed and consumption rate and guide rolls to guide the tubing into the mandrel.

During operation, the fibrous filter material is fed in web form into the nozzle and formed around the mandrel before passing out of the nozzle into the forming means. The tubing is simultaneously fed from the supply reel and is passed through the mandrel to a point where the friction of the moving fibrous filter material created by a constriction of the fibrous material in the forming means is sufficient to pull the tubing at a uniform rate.

The nozzle for enveloping the mandrel with fibrous material embodies an annular Venturi-like opening such that air or gas can be injected into the fibrous filter material at high velocity and at an angle concurrent with the flow of fibrous material. The injected air serves to push the fibrous material into the forming means relaxing the tension on the fibers of the material. The effect of this relaxation along with the escapement of air through the fibrous material at the exit of the nozzle is to bloom and to uniformly distribute the fibrous material about the mandrel. The size of the nozzle would, in general, be dependent upon the size and number of fibers being supplied; however, a nozzle of about two inches diameter at the entrance and about ⅝ inch diameter at the exit has been used. The Venturi-opening and air pressure can be varied, but an opening of about 0.15 inches and a pressure of about 25 psig has been satisfactory.

The mandrel serves to constrain and guide the tubing along its path, essentially axially aligned with the filter rod until the fibrous material is evenly distributed about the mandrel and tubing and the pressure of the constrained fibrous material is sufficient to constrain the tubing. Vertical and lateral adjustments can be made in the mandrel to allow the mandrel to be positioned independently of the forming means and the nozzle. In effect, this allows adjustment of the radial position of the tubing within the produced filter rod. The mandrel bore should provide a light sliding fit with the tubing and the mandrel outer diameter should be a minimum compatible with the bore. For example, a mandrel outer diameter of 0.25 inches and a bore of 0.18 inches has been useful with a tubing of 0.125 inch outer diameter.

These and other objects and advantages of the invention will become more apparent from the following detailed description and appended claims taken in conjunction with the accompanying drawings in which:

Figure 1:
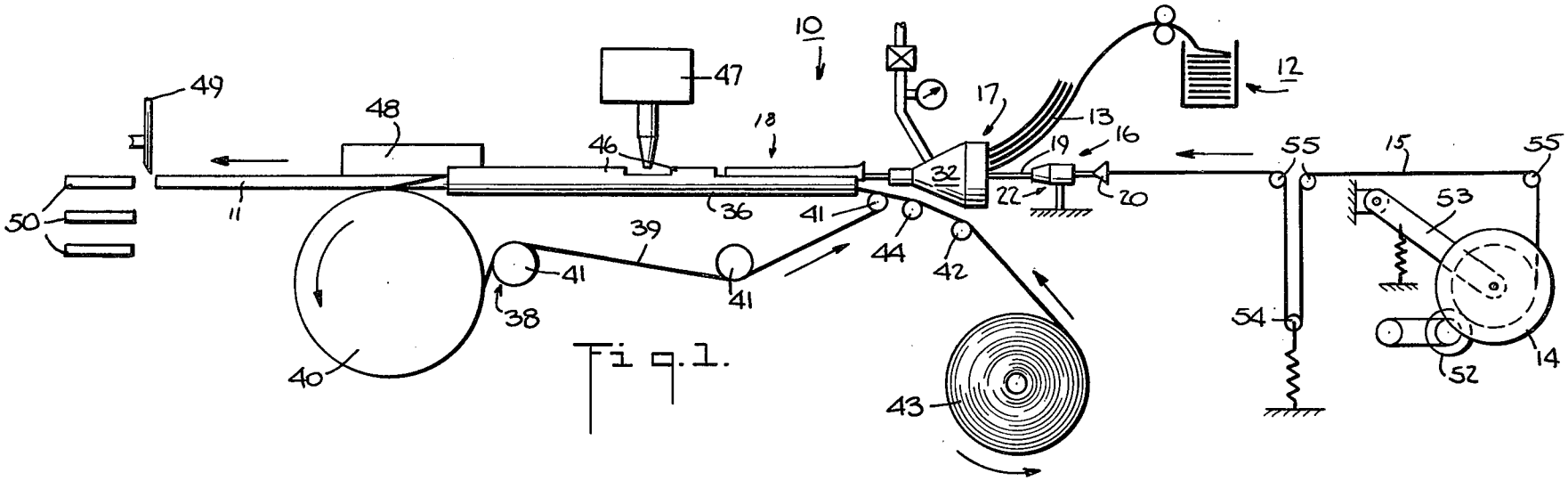
FIG. 1 illustrates a schematic view of an embodiment of an apparatus for making a hollow filter rod according to the invention.

Referring to FIG. 1, the apparatus 10 for making a hollow filter rod 11 includes a means 12 for supplying a stream of fibrous filter material 13 such as a cellulose acetate tow and a means such as a supply reel 14 for supplying a stream of tubing 15, for example, of hollow plastic material. In addition, the apparatus 10 includes a guide means 16 positioning the stream of tubing 15 in a predetermined path, a means 17 for shaping the stream of fibrous filter material 13 about the tubing 15 and a rod former 18 of conventional construction for wrapping the streams of filter material and tubing into the filter rod 11.

Figure 2:
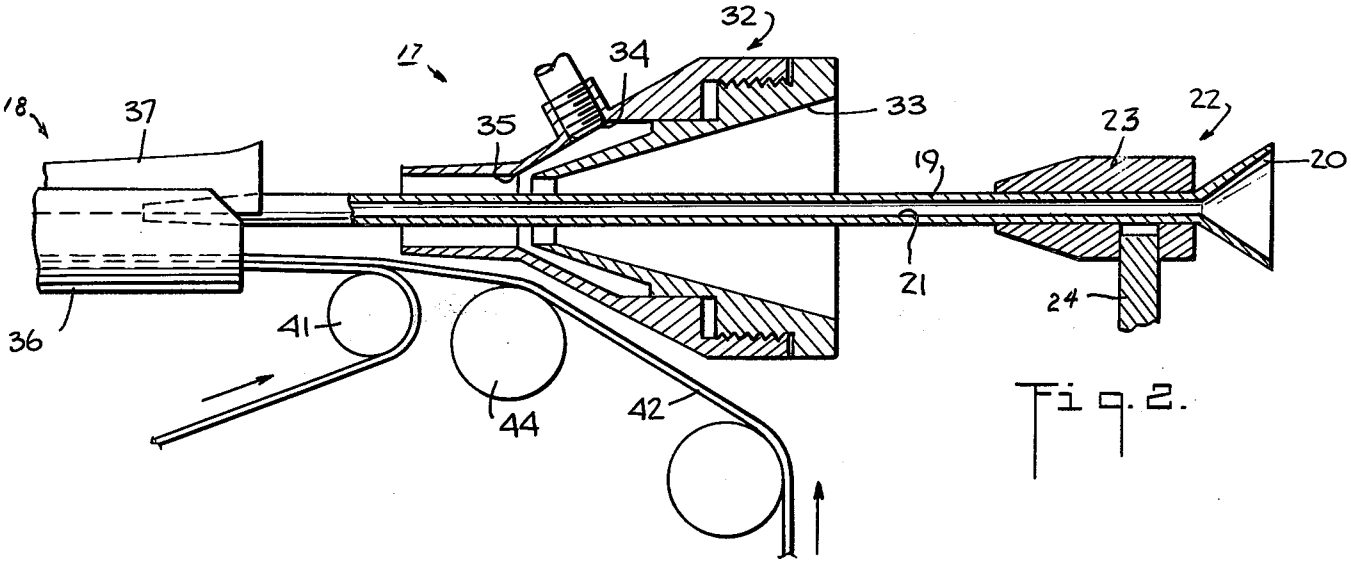
FIG. 2 illustrates an enlarged partly cross-sectional view of the apparatus according to the invention.

Referring to FIGS. 1 and 2, the guide means 16 for the tubing 15 is positioned downstream of the supply reel 14 and includes a hollow mandrel 19 of elongated length which passes through the shaping means 17 into the rod former 18. The mandrel 19 has a funnel shaped inlet 20 at the upstream end to guide the stream of tubing into an internal passageway 21. In addition, the mandrel 19 is mounted in cantilever manner on a support 22 for adjusting the mandrel 19 vertically and horizontally.

Figure 3:
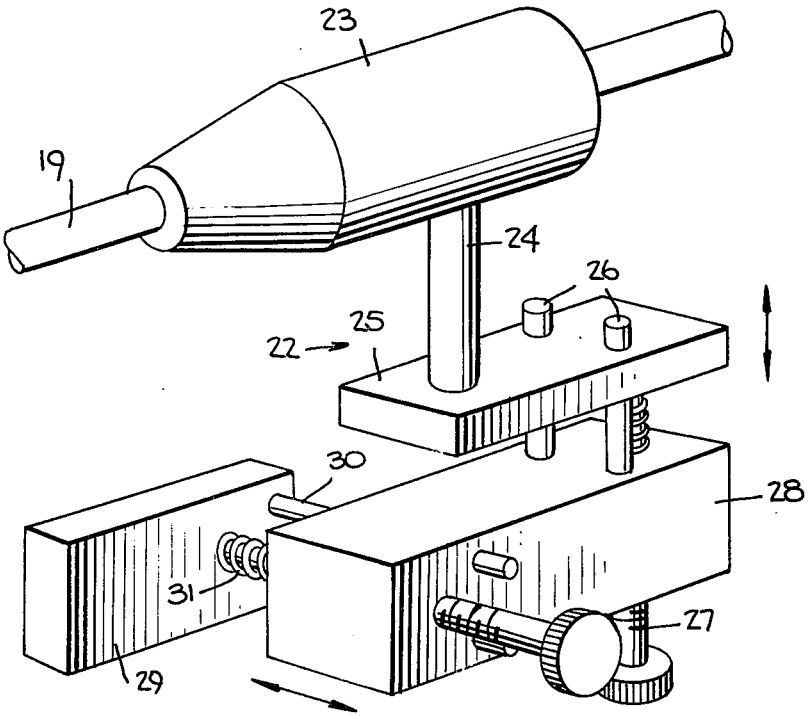
FIG. 3 illustrates a perspective view of the mandrel of FIG. 1.

As shown in FIG. 3, the mandrel support 22 includes a sleeve 23 mounted via a post 24 on a bracket 25 which in turn is mounted by means of two guide rods 26 and a spring-loaded adjustment screw 27 to a block 28. The bracket 25 can be adjusted vertically with respect to block 28 by means of the adjustment screw 27 which is captive but free to rotate in the bracket 25 and threaded into the block 28. The block 28 is similarly mounted to and horizontally adjustable with respect to a stationary bracket 29 via guide rods 30 (only one shown) and a spring-loaded adjustment screw 31. The passageway 21 of the mandrel 19 is of substantially uniform diameter throughout while the free end of the mandrel 19 is tapered for purposes as described below.

Referring to FIG. 2, the means 17 for shaping the stream of filter material 13 about the tubing 15 includes a nozzle 32 positioned about the mandrel 19 in coaxial fashion. This nozzle 32 is similar to that described in British Pat. No. 933,827. That is, the nozzle 32 includes an internal bore 33 of Venturi-shaped configuration, an annular air chamber 34 which receives air from a suitable air supply source (FIG. 1) and surrounds the Venturi-shaped bore 33, and a Venturi-opening 35 communicating the chamber 34 with the bore 33 to direct a flow of air in a direction towards the free end of the mandrel 19. The entrance end of the nozzle bore 33 is sized to receive the stream of filter material 13 with the material in a spread and decrimped manner from the filter material supply 12.

The rod former 18 is constructed with a forming block 36 and a tongue 37 mounted on the topside of the block 36. The block 36 and tongue 37 form a passageway (not shown) of circular cross-section into which the mandrel 19 projects. This latter passageway is sized to receive the tubing 15 passing through the mandrel 19 and the fibrous filter material 13. The tongue 37 and the forming block 36 are also tapered internally to form an inwardly tapering surface for the passageway so that the passageway gradually diminishes in cross-section. In addition, the rod former 18 includes a conveyor 38 having a conveyor belt 39, such as a continuous fabric belt, which is driven by a belt drive wheel 40 over guide rolls 41 through the passageway formed by the block 36 and tongue 37. The belt 39 is used to move a stream of perforated or porous web 42 e.g. plugwrap paper from a suitable supply reel 43 into the passageway via guide rollers 44 as well as to convey the filter material and tubing streams 13, 15. The web 42 has a uniform pattern of perforations 45 (FIG. 4) throughout or is inherently porous for purposes as explained below.

As shown in FIG. 1, the rod former 18 includes a pair of folding sections 46 as are known, a glue or adhesive applicator 47 and a sealer 48. The folding sections 46 serve to fold the edges of the delivered perforated or porous web 42 towards each other in enveloping relationship to the filter material and the tubing while the adhesive applicator 47 serves to apply a line of adhesive on the top surface of one edge so that the undersurface of the opposite edge can be sealed thereto by the subsequent folding section 46 and sealer 48 to from the filter rod 11. The web 42 may also be of a type which has a heat-activated resin pre-applied to the surface of the web 42, in which case, the glue or adhesive applicator 47 may be eliminated.

A suitable cutting mechanism utilizing a knife 49 is disposed downstream of the sealer 48, as is known, for cutting the filter rod 11 into pedetermined lengths 50. Each length may thereafter be cut nto a multiplicity of filters.

Referring to FIG. 1, in operation, a stream of filter material 13 is fed from the supply source 12, is spread out and decrimped in a conventional fashion as is known and delivered into the nozzle 32. In addition, a length of tubing 15 is taken from the supply reel 14 and passed into the mandrel 19. After the filter material stream 13 is passed into the nozzle 32, the air which is supplied to the nozzle 32 causes the material to bloom, for example, as described in U.S. Pat. No. 3,367,447. This allows the fibrous material to be pushed along the surface of the mandrel 19 into the rod former 18 rather than pulled. Thereafter, as the filter material 13 is passed into the rod former 18 between the folding block 36 and the tongue 37, the fibrous material is gradually reduced circumferentially due to a tapering of the tongue 37 relative to the forming block 36. The filter material 13 is then brought into direct contact with the tubing 15 which passes out of the mandrel 19 within the rod former 18 and is juxtaposed in enveloping circumferential relationship with the tubing 15. At the same time, the web of paper 42 is guided into the rod former 18 underneath the tubing 15 and filter material 13 and folded into a generally U-shape. Continued travel of the tubing and filter material causes the filter material to be constricted circumferentially about the tubing 15 to grasp or to frictionally engage the tubing 15 under a force sufficient to continuously pull the remaining tubing 15 supplied from the reel 14 through the mandrel 19.

The movement of the fibrous material 13 through the rod former 18 is facilitated by the conveyor belt 39 and the paper web 42 as is known. In addition, the paper web 42 is subsequently folded about the constricted filter material 13 and the engaged tubing 15 with the paper edges sealed together to form a filter rod 11 of continuous length. The filter rod 11 is then severed into predetermined lengths 50 by the knife 49.

Referring to FIG. 1, the rotational speed of the tubing supply reel 14 and the take off speed of the tubing 15 is controlled by an elastic-faced roll 52 frictionally driven against the outer layer of tubing on the reel 14. The roll 52 is driven by either an auxiliary motor or a suitable connection with the belt drive wheel 40 such that the peripheral speed of roll 52 is matched to the linear speed of the conveyor belt 39. The tubing 15 is threfore fed from the reel 14 at a rate approximately equal to the rate of consumption. The reel 14 rotates on a shaft attached to a hinged arm 53, which is free to rotate and is suitably loaded by either a spring or weight so that a firm contact is always maintained between roll 52 and the outermost layer of tubing on the reel. A spring-loaded or weighted take-up roll 54, in cooperation with guide rollers 55, maintains a reservoir of tubing to accommodate small variations between the take off and consumption rates, such as will occur in the transition in the outermost layer of tubing on reel 14. The guide rollers 55 further serve to guide the tubing 15 towards the mandrel 19.

Figure 4:
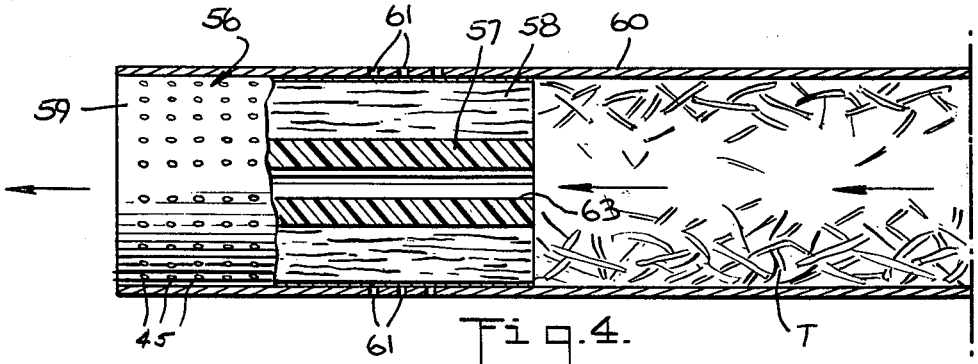
FIG. 4 illustrates a part cross-sectional view of a cigarette having a filter made in accordance with an apparatus and method of the invention.

Referring to FIG. 4, a filter 56 formed from the filter rod 11 includes a hollow cylindrical tube 57 surrounded by an annular layer of compacted filter material 58, a wrapping of perforated plugwrap paper 59 and an outer wrap of tipping paper 60. The filter 56 is mounted, as is known, by means of the outer wrap of tipping paper 60 on a tobacco column T to form a cigarette. The outer wrap of tipping paper 60 is provided with a number of circumferential rows of perforations 61 which are located at about the mid-section of the filter 56.

Figure 5:
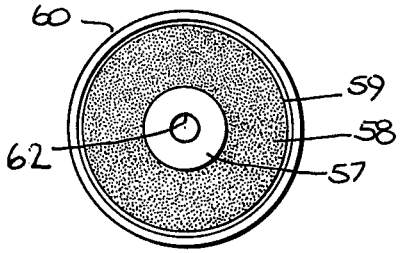
FIG. 5 illustrates an end view of the filter of FIG. 4.

As shown in FIG. 5, the tube 57 is centered on the axis of the filter 56 and forms a passageway 62 which serves as a bypass passage for unfiltered smoke.

As shown in FIG. 4, as the smoker takes a puff of his normal puff volume, the smoke flow through the cigarette and the central tube 57 and the air flow through the perforations in the tipping and filter material are proportional to the draw resistance of these two passageways. Since the draw resistance of the whole length of filter material is relatively high there is very little communication between the tobacco column and the smoker's mouth through the filter material.

The smoke generated in the burning cigarette cone during the puff, upon reaching the filter 56, travels predominantly through the unencumbered passageway 62 in the tubing 57 and reaches the smoker's mouth in an unfiltered and undiluted state and at a relatively high velocity. Even though the quantity of this smoke is reduced when compared to normal filter cigarettes, its unfiltered and undiluted state and its high impingement velocity have the effect of enhancing the taste of the cigarette to the smoker.

A relatively small amount of smoke generated in the cigarette cone passes into the compacted filter material 58 and becomes filtered almost completely.

The other part of the smoker's puff volume brings in air from the surrounding environment via the perforations 61 in the tipping paper, through the plugwrap paper 59 and the filter material 58 into the smoker's mouth. The air does not mingle with smoke until delivered into the smoker's mouth. This enhances the possibility of the smoker getting an increased flavor impression from the delivered smoke stream. In conventional cigarettes utilizing perforated tipping, diluting air and smoke mix within the filter with the delivered smokestream being prediluted before impinging in the smoker's mouth.

The amount and velocity of the smoke stream and of the air stream can be regulated by varying the respective draw resistances of the two passageways and the smoke yield of the cigarette can be varied over a wide range by choice of proper combinations of the two draw resistance.

Since it has been found that the diameter of the passageway 62 is critical, it can only be maintained by rigid elements. Thus, the tube 57 is of such a material and/or construction to remain underformed during use. The tube 57 may thus be characterized as a self-supporting, non-deformable rigid tube of sufficient strength to maintain the integrity of the passageway.

The apparatus and method have been used successfully to make 150mm long, 24.62mm filter rods on production machinery at a production rate of 500 rods per minute using 3.0 dpf 48,000 total denier cellulose acetate tow and low density polyethylene tubing. The maximum deviation of the tubing from an adjusted position was observed to be no more than 0.5mm. The particular tow and tubing used in this example have no particular significance as far as the method of the invention is concerned and a wide range of specifications should be tolerable. However, inordinate increases in the tubing diameter and thickness would eventually lead to a limiting condition where either the annular tow span is too restricted or the filter rod becomes too difficult to cut. The tubing material is not necessarily restrictive; however, low density materials are preferred from the standpoints of cost, filter weight and cutting.

Using the filter rods four 100mm sample cigarettes were fabricated and submitted to standard analytical smoking tests. The data listed in Table 1 below are typical of results that can be obtained with the filter of this invention. The yield reductions are calculated on the basis of the same tobacco column smoked without a filter.

Table 1

| Analytical data for four sample cigarettes | | | | |
|---|---|---|---|---|
| Sample No. | 89 W | 59 U | 87 W | 60 U |
| Pressure drop of perforations (cm $H_2O$) | 16.3 | 17.2 | 9.0 | 7.8 |
| Pressure drop of tubing (cm $H_2O$) | 8.1 | 9.1 | 7.6 | 9.7 |
| Tubing I.D. (mm) | 0.982 | 0.955 | 1.002 | 0.945 |
| Diluting air (%) | 38.6 | 41.2 | 55.8 | 60.6 |
| Yield reduction (%) per cigarette | | | | |
| NFDS | 46.6 | 57.4 | 58.0 | 69.8 |
| Nicotine | 41.3 | 46.2 | 51.1 | 58.6 |
| HCN | 57.5 | 67.8 | 76.3 | 83.0 |

Referring to FIG. 1, since the filter material 13 is constrained and compressed between the self-supporting tubing 15 and the enveloping paper web 42, the filter rod 11 is substantially rigid without the use of a plasticizer on the material 13 or the associated curing process that is used to achieve rigidity in filters of conventional construction. Furthermore, referring to FIG. 4, since a relatively small amount of the smoke follows the path through the filter material 58, a plasticizer on material 58 would not serve in the usual capacity of selectively removing phenol from the smoke stream. Thus, the filter construction made according to the apparatus and method of this invention affords the option of eliminating the application of a plasticizer and the associated curing process. As a result, the apparatus 12 can be of simple construction and the usual cure time between formation of the filter rod and its application to cigarettes can be eliminated.

It is to be noted that the mandrel 19 can be easily incorporated into existing machinery at relatively minor cost. Further, since the tube supply reel 15 is of simple construction, the overall cost of modifying existing machinery to produce hollow filter rods can be relatively small.

As can be seen from FIG. 5, the invention provides a cigarette filter in which a hollow tube is radially centered to achieve a symmetrical construction and an aesthetically pleasing appearance at the exposed end of a cigarette. Should any misalignment of the tube occur, the mandrel 19 (FIG. 1) can then be adjusted in an appropriate manner to again align the tubing in the proper place and bring about a centering of the tubes in subsequently made filters.

What is claimed is:

1. An apparatus for making a filter rod for cigarette filter tips comprising first means for supplying a stream of tubing;

a mandrel having a passageway for passage of a supplied stream of tubing therethrough;

second means for supplying a stream of fibrous cigarette filter material third means circumferentially enveloping said mandrel for directing a supplied stream of fibrous filter material circumferentially about said mandrel;

fourth means for supplying a stream of paper;

forming means circumferentially enveloping the delivery end of said mandrel and positioned downstream of said third means for receiving the supplied streams of tubing, filter material and paper, said forming means causing said filter material to frictionally engage said tube, and to circumferentially envelop the paper stream about juxtaposed streams of filter material and tubing to form a filter rod;

means for cutting said filter rod into predetermined lengths.

2. An apparatus as set forth in claim 1 wherein said first means includes a supply reel for feeding a continuous length of tubing therefrom and a means for driving said reel to feed the tubing from said reel at a rate equal to the rate of consumption.

3. An apparatus as set forth in claim 1 wherein said forming means includes a forming block for folding the sides of the stream of paper around the juxtaposed streams of filter material and tubing while compressing the filter material around the tubing and a tongue mounted on said forming block to guide the stream of filter material therebetween, and wherein said mandrel projects into said forming means under said tongue.

4. An apparatus as set forth in claim 3 wherein said mandrel is adjustably mounted with respect to said forming means.

5. An apparatus as set forth in claim 1 wherein said second means includes a nozzle having a Venturi-shaped passageway for passage of the stream of filter material and wherein said Venturi-shaped passageway and said mandrel passageway are coaxial.

6. In an apparatus for making a filter rod having a means for forming a traveling stream of fibrous filter material and an enveloping stream of paper into a filter rod, means for placing a length of tubing concentrically within said filter material of said filter rod with said filter material being in frictional engagement with the tubing under a circumferentially applied compressive force, said latter means including a mandrel having a passageway for passage of the tubing therethrough and a nozzle concentrically disposed about said mandrel for shaping the fibrous filter material about said mandrel and the tubing passing therethrough said mandrel having a delivery end circumferentially enveloped by said means for forming to cause said frictional engagement.

7. In an apparatus as set forth in claim 6 wherein said means for forming is downstream of said nozzle to receive the fibrous filter material and the tubing, and includes a forming block for folding the sides of the paper around the received fibrous filter material and tubing and a tongue mounted on said forming block to guide the filter material into said block with said mandrel projecting into said block under said tongue.

8. In an apparatus as set forth in claim 7 wherein said mandrel is adjustable relative to said tongue.

9. An apparatus as set forth in claim 3 wherein the tongue and forming block are tapered internally to provide an inwardly, tapering surface.

10. In an apparatus as set forth in claim 8 wherein the tongue and forming block are tapered internally to provide an inwardly tapering surface.

* * * * *